US010562736B1

(12) United States Patent
Davis, Jr. et al.

(10) Patent No.: US 10,562,736 B1
(45) Date of Patent: Feb. 18, 2020

(54) RETRACTABLE OXYGEN SUPPLY-HOSE REEL AND MECHANISM HOUSING COVER FOR MEDICAL OXYGEN THERAPY DEVISES AND MEDICAL OXYGEN TREATMENT DEVISES

(71) Applicant: BIG E-Z REEL, LLC, Independence, LA (US)

(72) Inventors: James Jack Davis, Jr., Independence, LA (US); Antonino F. Anzalone, Independence, LA (US); Vincent F. Falcone, Jr., Independence, LA (US)

(73) Assignee: BIG E-Z REEL, LLC, Independence, LA (US)

( * ) Notice: Subject to any disclaimer, the term of this patent is extended or adjusted under 35 U.S.C. 154(b) by 0 days.

(21) Appl. No.: 16/517,047

(22) Filed: Jul. 19, 2019

Related U.S. Application Data

(63) Continuation of application No. 13/925,521, filed on Jun. 24, 2013, now Pat. No. 10,392,221.

(60) Provisional application No. 61/739,184, filed on Dec. 19, 2012.

(51) Int. Cl.
*B65H 75/44* (2006.01)

(52) U.S. Cl.
CPC ..... *B65H 75/4434* (2013.01); *B65H 2701/33* (2013.01)

(58) Field of Classification Search
CPC .. B65H 75/4434; B65H 75/48; B65H 75/486; B65H 75/4478; B65H 2701/33
See application file for complete search history.

(56) References Cited

U.S. PATENT DOCUMENTS 3,657,491 A * 4/1972 Ryder ..... B65H 75/4434 191/12.2 R
3,834,645 A * 9/1974 Morishige ..... B65H 75/4434 242/385.3
5,381,820 A * 1/1995 Chandler ..... B65H 75/441 137/355.16
5,975,120 A * 11/1999 Novosel ..... A61M 16/0666 137/355.23

(Continued)

FOREIGN PATENT DOCUMENTS

DE 2240288 10/1973

*Primary Examiner* — Sang K Kim
*Assistant Examiner* — Nathaniel L Adams
(74) *Attorney, Agent, or Firm* — Garvey, Smith & Nehrbass, Patent Attorneys, L.L.C.; Charles C. Garvey, Jr.; Vanessa M. D'Souza

(57) ABSTRACT

This invention modifies and redesigns a spring-loaded, retractable supply hose mechanisms used to pan out, retract, and store hoses used for gases (e.g., oxygen), treatments, or fluids, specifically this inventor's prior art, the Retractable Oxygen Supply Hose Mechanism, U.S. Pat. No. 6,065,490. This invention incorporates an "Adaptor Cap" or "Removable Cap" to prevent slippage of the Swivel connector, incorporates a "Removable Cap" into the upper disc or flange of the supply-hose reel and/or into the mechanism housing cover that acts as an "anti-rotational" device, and features bearing surfaces to prevent reel slippage. This internal ratchet system better prevents binding and kinking of the patient's supply, thereby facilitating the storage and the quick-controlled release of the desired amount of oxygen supply hose for patient's Medical Oxygen and other gases delivery, therapy, or treatments.

20 Claims, 8 Drawing Sheets

(56) References Cited

U.S. PATENT DOCUMENTS

| | | | | |
|---|---|---|---|---|
| 6,766,821 | B1 * | 7/2004 | Kovacik | B65H 75/38<br>137/355.23 |
| 6,803,525 | B1 * | 10/2004 | Liao | H02G 11/02<br>174/117 F |
| 10,392,221 | B2 * | 8/2019 | Davis, Jr. | B65H 75/4434 |
| 2014/0299133 | A1 * | 10/2014 | Neely | B65H 75/40<br>128/205.25 |

* cited by examiner

RETRACTABLE OXYGEN SUPPLY-HOSE REEL AND MECHANISM HOUSING COVER FOR MEDICAL OXYGEN THERAPY DEVISES AND MEDICAL OXYGEN TREATMENT DEVISES

CROSS REFERENCES TO RELATED APPLICATION

This is a continuation of U.S. patent application Ser. No. 13/925,521, filed on 24 Jun. 2013 (issued as U.S. Pat. No. 10,392,221 on 27 Aug. 2019), which claims benefit of U.S. Provisional Patent Application Ser. No. 61/739,184, filed 19 Dec. 2012, priority to and/or the benefit of each of which is hereby claimed.

STATEMENT REGARDING FEDERALLY SPONSORED RESEARCH OR DEVELOPMENT

Not Applicable

REFERENCE TO A MICROFILM APPENDIX

Not Applicable

BACKGROUND OF THE INVENTION

This invention relates to the modifications and redesigning of spring-loaded retractable supply hose mechanisms used for panning out, retraction and the storage of hoses used for oxygen, other gases, treatments or fluids, including intravenous lines, and specifically to this inventor's prior art, the Retractable Oxygen Supply Hose Mechanism, U.S. Pat. No. 6,065,490. In the course of production of the mechanism, some problems in design have been discovered leading to corrections and other improvements being made that are more efficient and cost-effective. The problems discovered included but are not limited to binding and kinking of hoses resulting in decreased oxygen flow, slippage of the supply hose reel, slippage of the swivel hose connector, impedance of the free movement of the supply hose, and the effectiveness of the spring mechanism design.

When supply hoses are strung out and cluttering floors they constitute not only a trip hazard to all, but also an inconvenience to the patient, therapist and caregivers who must manually roll out, roll up, and tie the hose. Further, the continuous exposure of greater lengths of the oxygen supply hose to ambient temperatures can lead to moisture accumulation in the hose, cannulas, and mask. Through a simply tug on the supply hose one controls the amount of length desired. Further, as often as required, the hose and connectors are quickly replaced by opening the "Mechanism Housing Cover", removing the "Supply Hose Reel" that includes the supply hose and the swivel connector, and replacing the used "Supply Hose Reel" with a sterile one. This replaceable "Supply Hose Reel" has the added feature of a molded in hose connector fitting which is the removable cap now incorporated within the central hub of the upper flange or the upper disc of the reel, eliminating the need for an additional part lowering the cost of the complete replacement unit of the "Supply Hose Reel" with the new connector and hose. This feature will lower production cost, thereby making it more affordable for patients desiring the convenience, for insurers, and also for those patients or caregivers who for any reason are unable or unwilling to rethread the original reel. For all others, the replacement of the hose and connector is done by opening the "Mechanism Housing Cover", then panning out all of the hose, removing the reel, removing the "Removable Cap" to gain access to the "Swivel Connector" and the end of the supply hose connected to it, disconnecting the used hose, removing the used connector, inserting a new sterile "Supply-Hose" through the ramp in the barrel of the reel and up through the top of the reel, inserting that end of the hose through the center of the removable cap, inserting the "Swivel Connector" into that end of the "Supply-Hose" that holds it firmly in its position in the removable cap, reinstalling or snapping the "Adaptor Cap" back into its position in the central hub of the "Supply Hose Reel", repositioning the "Supply Hose Reel" onto the "Spring-Loaded Disc", then tugging on the hose causing the reel to retract thus wrapping the "Supply Hose" about the reel and finally closing the "Mechanism Housing cover" ending the process.

BRIEF SUMMARY OF INVENTION

This invention modifies and redesigns a spring-loaded, retractable supply hose mechanism used to pan out, retract, and store hoses used for oxygen, gases, breathing treatments or fluids, including intravenous lines and specifically to this inventor's prior art, the Retractable Oxygen Supply Hose Mechanism, U.S. Pat. No. 6,065,490. This invention incorporates a removable snap-in adaptor cap to permit the rotation of the lower portion of a swivel connector with the upper flange of the reusable supply hose reel, or incorporates this feature into the upper flange a replaceable supply-hose reel. The reel base flange has four double-winged posts that prevent reel slippage from the spring-loaded disc. The reel housing cover has a feature that restricts movement of the upper portion of a swivel connector and features a bearing surface to prevent the reel disconnecting from the spring-loaded disc. The spring-loaded disc has an inner pawl affixed to its lower face angulated outwardly, which rotates with the disc in a closed internal Pawl ratchet system, that is incorporated into the housing base which has three equidistantly spaced and identical arch-shaped stops, high plateau ridges and lower plateau ridges along its inner periphery to engage and disengage the pawl. This internal Pawl ratchet system better prevents binding and kinking the patient's supply hose, thereby facilitating the storage and quick-controlled release of the desired length of supply hose for patient's Medical Oxygen and other gases delivery, therapies, fluids or treatments.

DETAILED DESCRIPTION OF THE INVENTION

Figure 1:
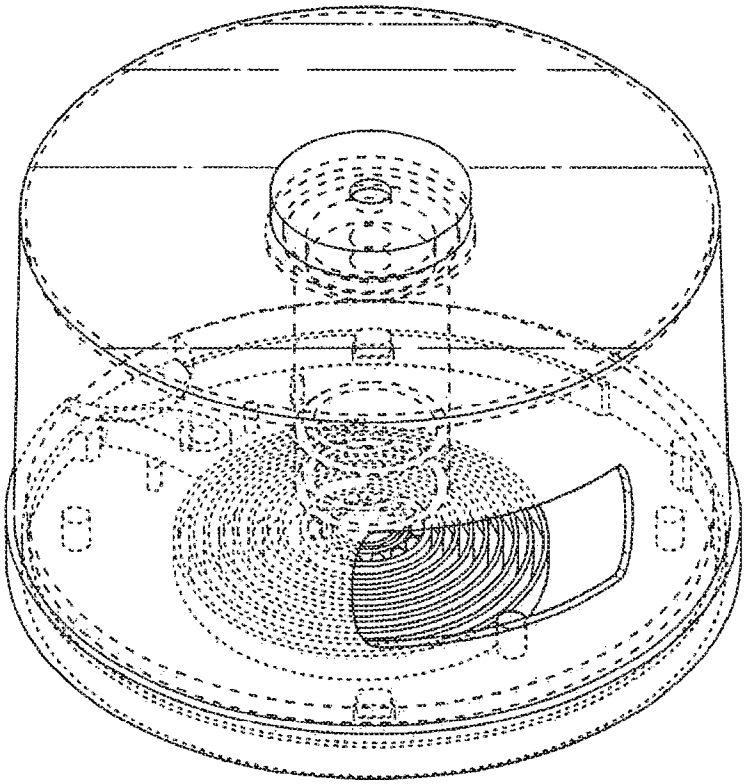
FIG. 1 is a perspective view of the assembled Retractable Supply hose Reel with its housing cover, Spring-loaded Disc, Housing Base and its Ratchet system.

FIGS. 1-8 depict a mechanism housing base 1, a spring-loaded disc 2, a detachable supply hose reel 3, and a mechanism housing cover 4 and the specific parts associated in the construction of this mechanism specifically identified in the following. Although the dimensions can vary, the overall size of the mechanism is approximately eight (8) inches wide by six (6) inches tall for gases and smaller for intravenous lines. It is made of plastic with a few metal parts such as the springs, screws, and ball bearings.

Figure 2:
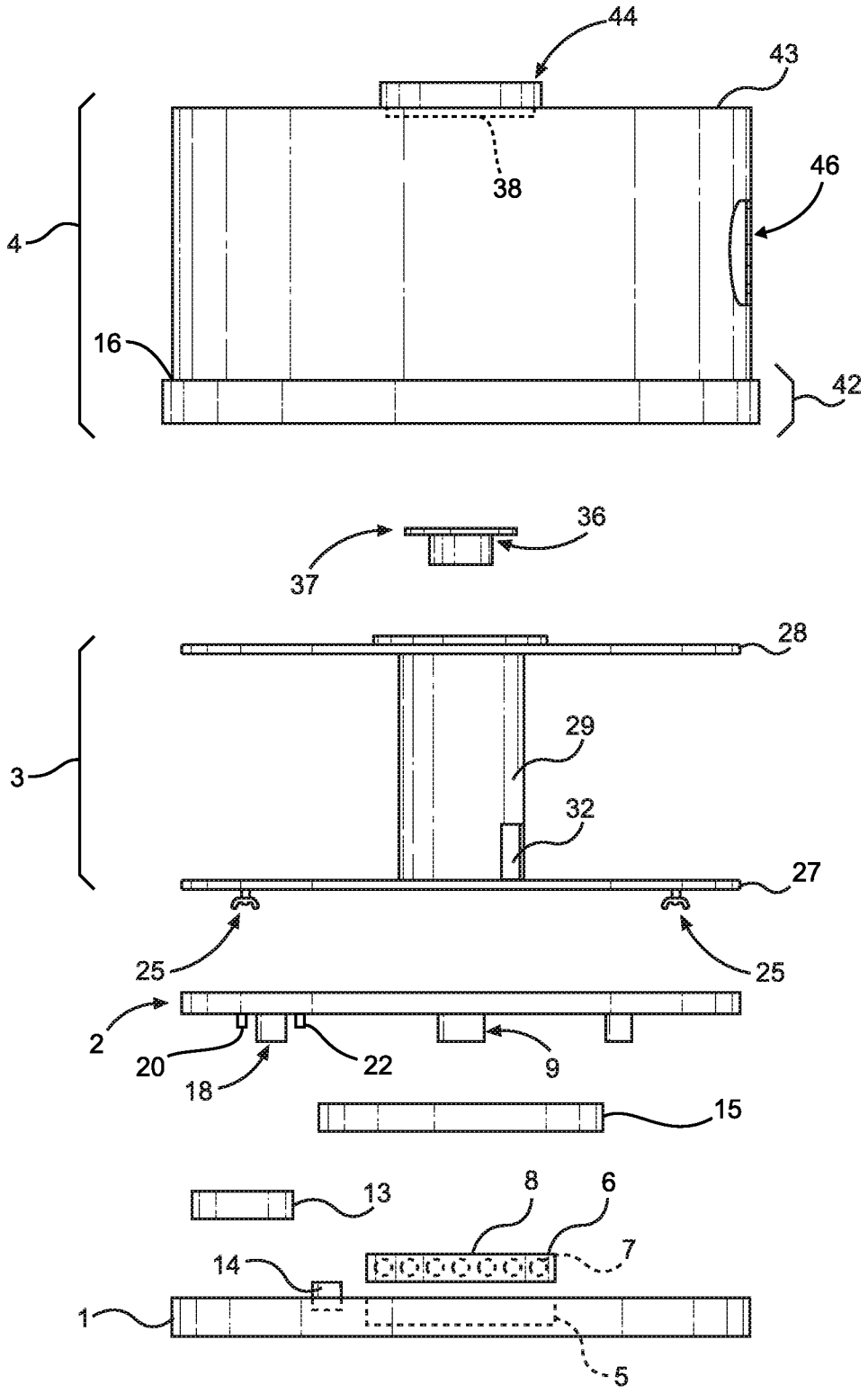
FIG. 2 is an exploded view of the Retractable Supply hose Reel with its housing cover, Spring-loaded Disc, Housing Base and its Ratchet system.
Figure 3:
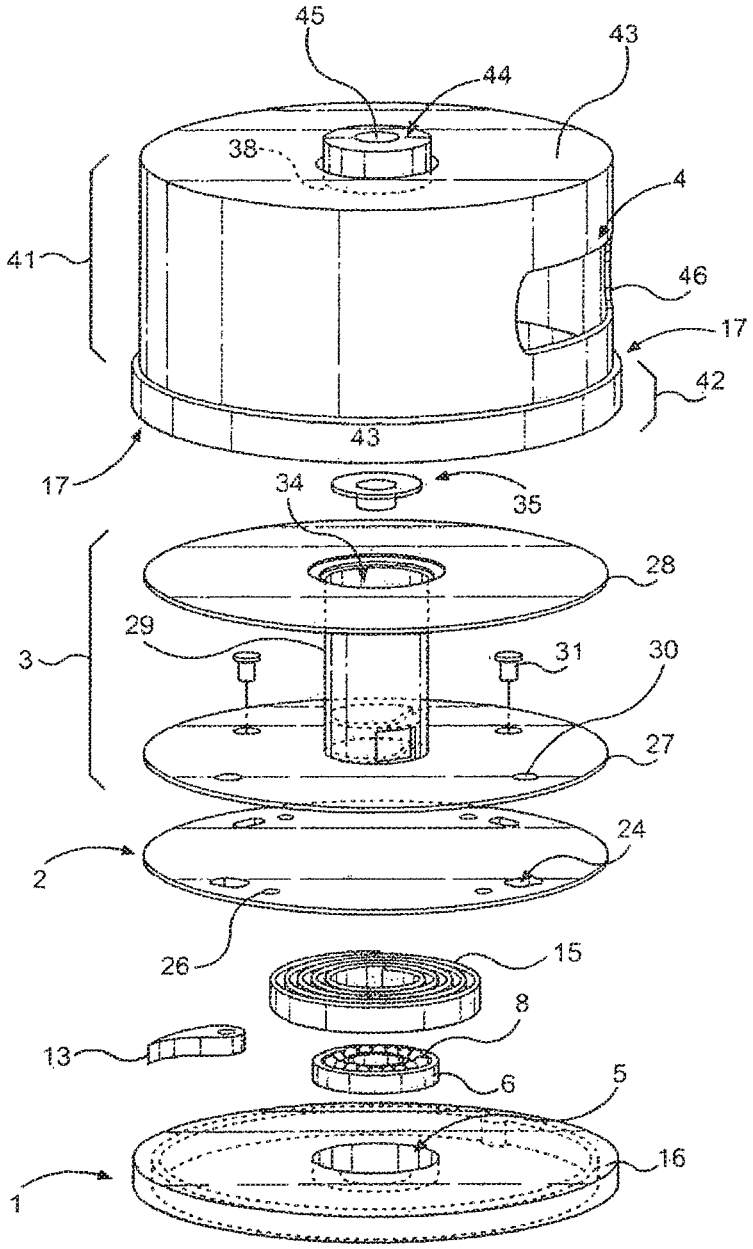
FIG. 3 is an exploded perspective view of the Retractable Supply hose Reel with its housing cover, Spring-loaded disc, Housing Base and its Ratchet system.
Figure 4:
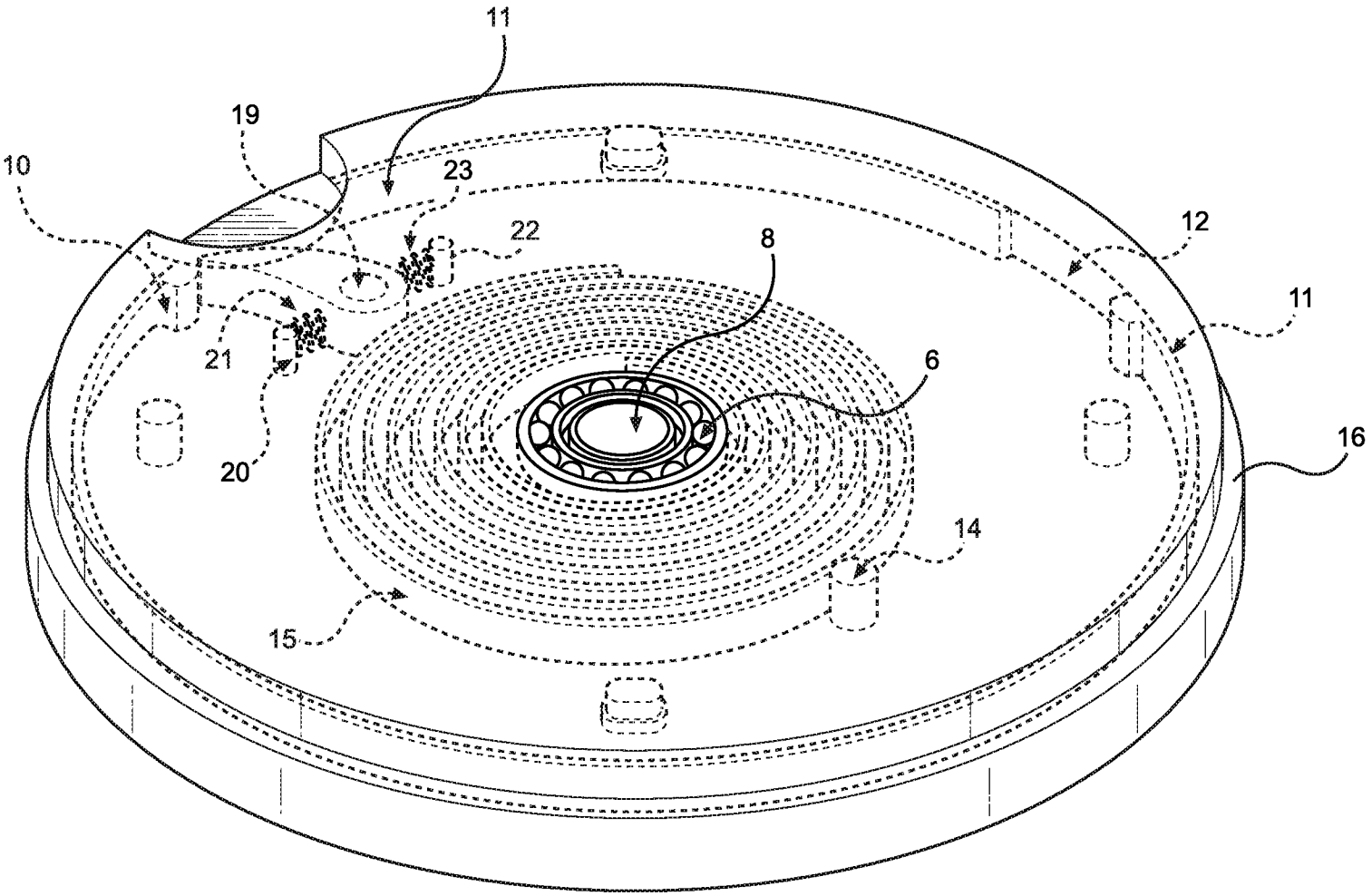
FIG. 4 is a view of the assembled Spring-loaded disc with the Housing Base and its Ratchet system.
Figure 5:
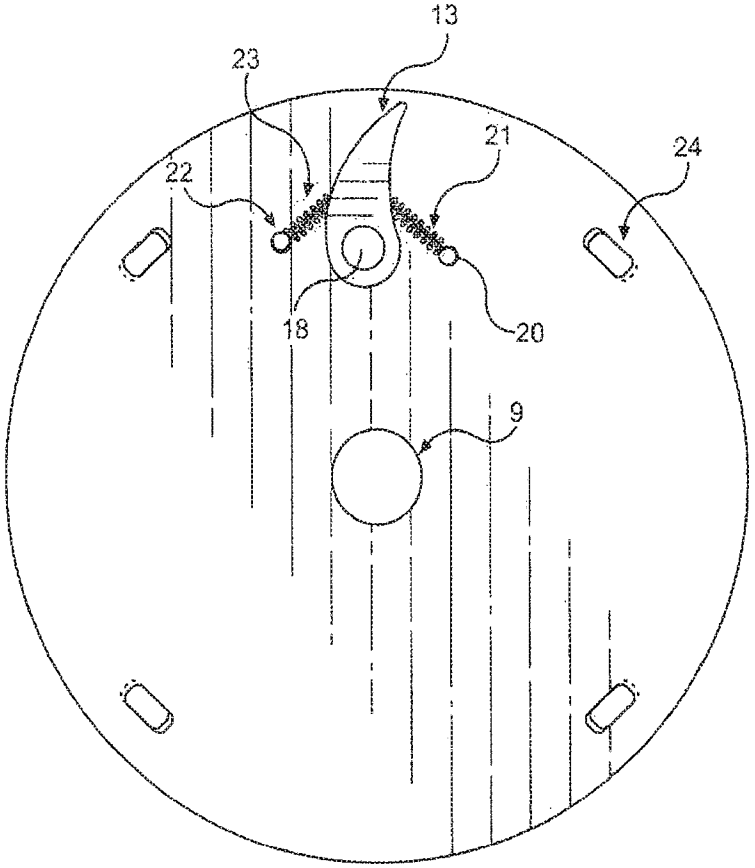
FIG. 5 is a view of the lower face of the Spring-loaded Disc.
Figure 6:
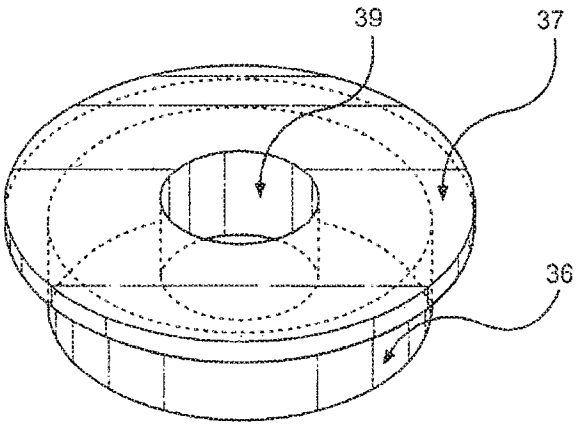
FIG. 6 is a view of the Adaptor Cap.
Figure 7:
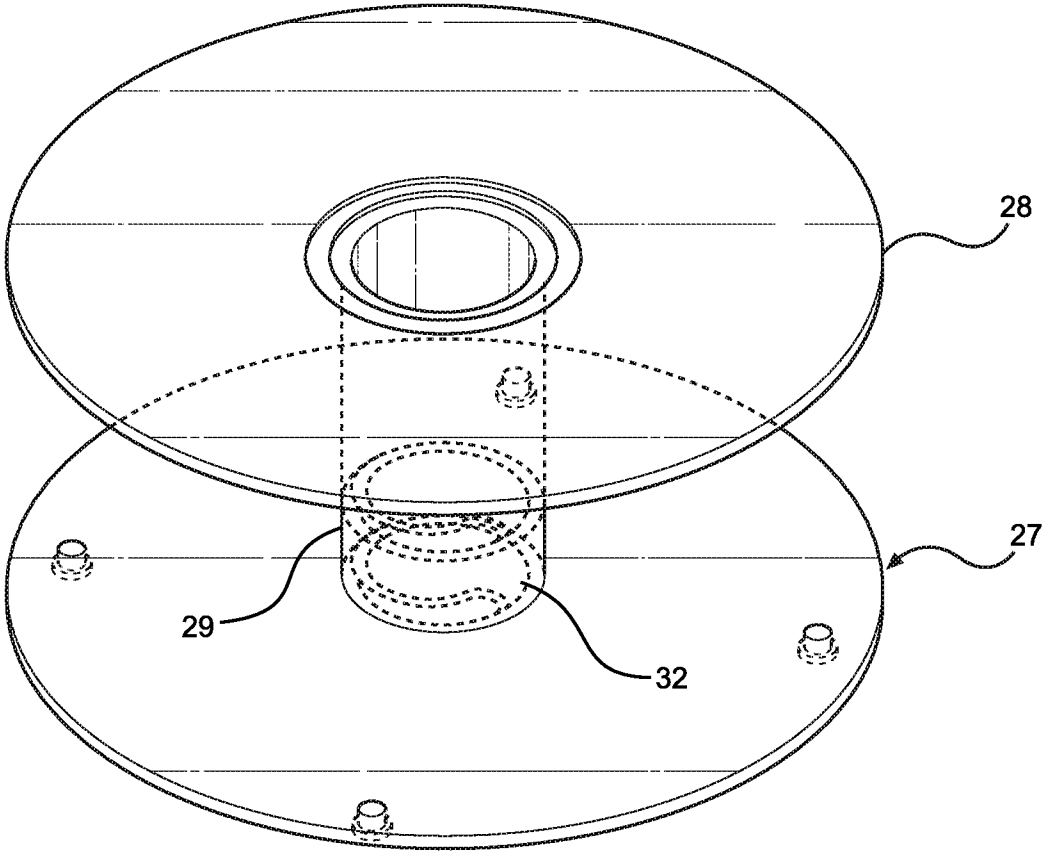
FIG. 7 is a perspective view of the Re-Thread-able Supply hose reel without the Adaptor Cap.
Figure 8:
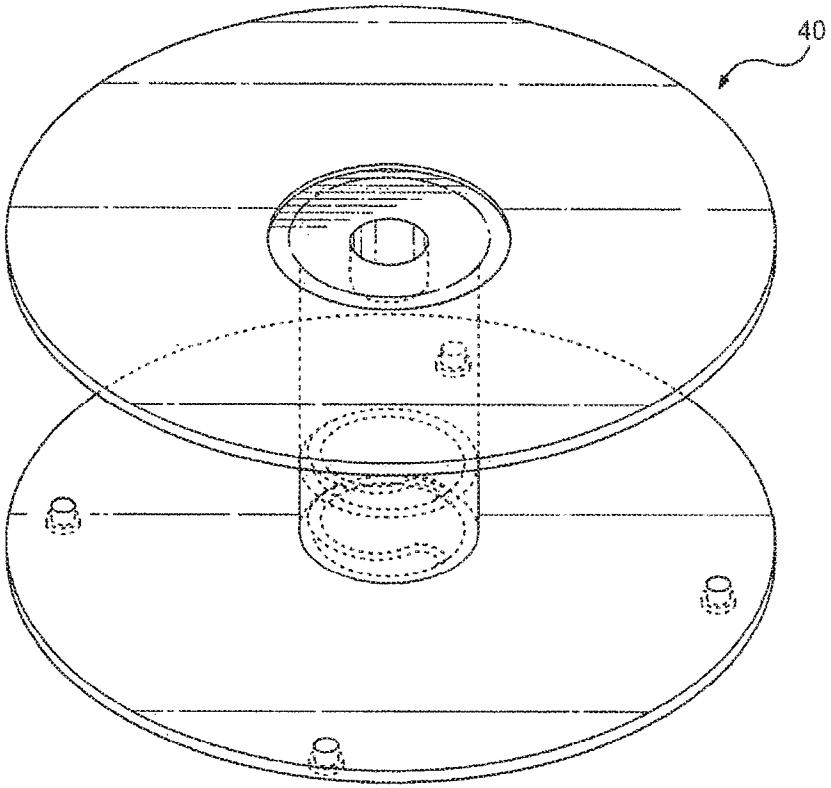
FIG. 8 is a perspective view of the Supply hose reel including the incorporated Adaptor Cap.

In FIG. 2 and FIG. 3, the mechanism has a housing base 1, a circular plate. The housing base is routed out to form a circular central bearing housing 5 that receives a circular ball bearing 6, comprised of individual ball bearings 7 and a rotating center race 8 that will receive a center axle 9 from the lower face of the spring-loaded disc 2. The housing base (FIG. 4) has been routed out to create a ratchet system comprised of three (3), arch-shaped stops 10, of equal size and equidistantly around the internal perimeter of the housing base. The stops are fixed on one side to three (3) high-plateau ridge spaces 11 each equal to one-sixth of the remaining internal perimeter and on the other side to three (3) lower plateau ridge spaces 12 each one equal in length to the high-plateau ridges. The oval stops 10, are of a sufficient size and angulation at the point of intersection with the high-plateau ridge to permit the engaging of a Pawl 13 (FIG. 3) and also sufficiently curved at the point of intersection with the lower-plateau ridge to permit the disengaging of said Pawl. The housing base has one large flat spring post 14, positioned at a point between the central bearing housing and the periphery of the housing base to which a flat spring 15 is attached at one end and the other end of the flat spring is attached to a center axle 9 (FIG. 2) extending from the lower face of the spring-loaded disc permitting the flat spring to wind and unwind without interfering with the movement of said pawl attached to the lower face of said spring-loaded disc as it rotates around the housing base.

The spring-loaded disc 2 is a circular plate that resembles a turntable in its design. It is not as wide as the mechanism housing base thus providing a rim 16 (FIG. 2 & FIG. 3) on the housing base perimeter on which the lower rim 17 (FIG. 3) of the mechanism housing cover 4 rest. The spring-loaded disc has a center axle 9 (FIG. 2) that extends from the lower face which is press fit and attached to the center race 8 of the mechanism housing base circular ball bearing 6. The spring-loaded disc has a larger sized pawl post 18 (FIG. 2) that extends from the lower face positioned about one inch from the edge. The pawl post is of a length that almost touches the upper face of the housing base when assembled. Seen in the view from the bottom of the spring-loaded disc (FIG. 5) and in the assembled view of the Mechanism Housing Base 1 and the Spring loaded disc 2 (FIG. 4) the pawl 13 slips onto said pawl post 18 by means of a hole 19 bore through the center of the circular portion of the pawl. The depth of the pawl is equal to that of the pawl post. The point of the pawl faces toward the outer edge of the spring-loaded disc plate allowing the pawl to engage and disengage the arch-shaped stops 10 as the pawl moves from side to side as the spring-loaded disc rotates clockwise or counter clockwise. There are two (2) smaller helical spring post located about three quarters (¾) of an inch on each side of the pawl post on the lower face of the spring-loaded disc. The pawl stop engaging helical spring post 20 has a helical spring 21 attached on one end to said engaging helical spring post and the other end to the inside curved part of the pawl 13. The pawl stop disengaging helical spring post 22 has a helical spring 23 attached on one end to the disengaging helical spring post and the other end to the outside curved part of the pawl 13. There are four (4) double-wing tab holes 24 in the spring-loaded disc plate positioned equal distance around the circumference of the disc and about one-half inch from the edge of the spring-loaded disc that receive the four (4) double-winged tabs 25 (FIG. 2) that extend from the tower face of the detachable hose reel. There are four (4) threaded holes 26 (FIG. 3) in the upper face of the spring-loaded disc plate that receive flat head or thumb screws, which secure the detachable hose reel to the spring-loaded disc plate.

The detachable supply hose reel 3 (FIG. 3) is composed of a bottom circular plate 27 and a top circular plate 28 attached by a hollow barrel 29. The hose reel bottom plate has four (4) double-winged tabs 25 that extend from its lower face and lock the hose reel into place on the spring-loaded disc upper face through the double-wing tab holes 24 when the hose reel rotates clockwise or counter clockwise. There are four (4) holes 30 in the hose reel bottom plate that match up with the four (4) threaded holes 26 in the upper face of the spring-loaded disc through which either the four (4) flat head screws or four (4) thumb screws 31 secure the detachable hose reel to the spring-loaded disc plate. The supply hose reel (FIGS. 2 & 7) has a bottom plate 27 which is bonded to one end of the hollow barrel 29. At the point of juncture, the hollow barrel has a soft curved ramp 32. This permits the patient's supply hose to pass through the ramp and then threaded up through the center of the hollow barrel up to and through the swivel connector adaptor cap 35. The top circular plate 28 of the supply hose reel is bonded to the top end of the hollow barrel 29. The center of the supply hose top plate has a hole 34 centrally located into which the supply hose reel swivel connector adaptor cap 35 is inserted and locked into place. The swivel connector adaptor cap (FIGS. 2 & 6) in appearance resembles an inverted skimmer straw hat with a shallow flat crown and wide brim. The diameter of the part of the swivel connector adaptor cap that looks like the flat crown part of the hat 36, which slips down into the centrally-located hole 34 in the top plate of the supply hose reel, is wide enough so that it fits tightly into the hollow barrel 29 of the supply hose reel 3. Said crown part of the adaptor cap is deep enough into the hollow reel barrel that will accommodate the length of the conical-shaped tips of patient's hoses. The brim part of the adaptor cap 37 is wide enough to hold the adaptor in position and to offer a raised surface which serves as a bearing surface onto which the bearing surface 38 of the lower face of the mechanism housing cover adaptor cap 44 will sit. The central hole in the adaptor cap 39 is large enough to allow the conical end of the supply hose to slip through, yet small enough to lock into place when a supply hose swivel connector is inserted in the conical end of the hose, causing the lower half of the swivel connector to rotate in union with the oxygen supply hose reel. The assembly of the patient's supply hose reel allows the hose and connector to be replaced as often as required by anyone. Optionally, the supply hose reel adaptor cap (FIG. 6) can be incorporated into the top plate of the supply hose reel (FIG. 8) creating a one-piece swivel adaptor top plate 40 that eliminates the need for a separate part and providing a complete replacement oxygen supply hose reel with the patient's supply hose and swivel connector assembled and supplied by the manufacturer.

The supply hose mechanism housing cover 4 (FIG. 2) is composed of a barrel 41 that is a wide as the mechanism housing base and sits firmly upon it; a lower rim band 42 that is an inch wide and of a sufficient diameter to fit tightly onto the outer surface of the housing base; a flat housing cover top plate 43 that is bonded to the housing barrel, and a centrally located mechanism housing cover adaptor cap 44. This adaptor cap has an aperture shaped like the swivel connectors 45 and holds the top part of the swivel connector stable preventing the supply hose from kinking or binding. The lower face of the housing cover adaptor cap 38 is deep enough to provide a bearing surface that sits upon the upper bearing surface of the supply hose reel adaptor cap 37, which holds the supply hose reel firmly in place. The height of the mechanism housing cover exposed so that another supply hose's conical tip can be attached. On the side of the mechanism housing cover (FIGS. 1 & 3) is an oval shaped opening 46 measuring about two (2) inches high and five (5) inches wide, smaller for intravenous lines, through which the supply hose pans in and out from the reel. By means of a typical hinged connector attached to the housing mechanism base (not shown), this oval shaped opening is always directed toward the patient.

We claim:

1. An oxygen hose reel mechanism for medical oxygen supply for treatment or therapy comprising:

a) a hose reel having upper and lower flanges and a center of rotation, said lower flange having an upper surface and a lower surface;

b) the hose reel including a barrel having a central passageway, said barrel joining the flanges together;

c) a base having one or more peripherally positioned teeth;

d) a spring loaded disk rotatably mounted to said base and having a peripheral portion;

e) a coil spring providing an interface between the base and the spring loaded disk;

f) a connection that connects the lower flange of the reel to the spring loaded disk so that the reel rotates with the spring loaded disk;

g) a pawl secured to the spring loaded disk in between the coil spring and the disk peripheral portion;

h) the coil spring enabling a user to pay out or rewind a hose stored on the reel as the reel rotates relative to the base;

i) the pawl locking the reel to stop rotation of the reel when the pawl engages a tooth on the base;

j) the reel having a laterally extending hose opening extending from the outside of the barrel to the central passageway; and k) said reel having a flange opening through said upper flange that is sized and shaped to enable passage of the hose through the flange at said flange opening.

2. An oxygen hose reel mechanism for medical oxygen supply for treatment or therapy comprising:

a) a housing assembly that includes a hose reel having upper and lower flanges and a center of rotation, said lower flange having an upper surface and a lower surface, said upper flange having an opening;

b) the hose reel including a barrel having a control vertical passageway, said barrel joining the flanges together;

c) the housing assembly including an annular cover that fits over the hose reel, said annular cover having a cover opening;

d) a base having one or more peripherally positioned teeth;

e) a spring loaded disk rotatably mounted to said base and having a peripheral portion;

f) a centrally located coil spring providing an interface between the base and the spring loaded disk;

g) a connection that connects the lower flange of the reel to the spring loaded disk so that the reel rotates with the spring loaded disk;

h) a pawl secured to the spring loaded disk in between the coil spring and the disk peripheral portion;

i) the coil spring enabling a user to pay out or rewind a hose stored on the reel as the reel rotates relative to the base;

j) the pawl locking the reel to stop rotation of the reel when the pawl engages a tooth on the base;

k) the reel having a passage from the outside of the barrel to the barrel central vertical passageway; and l) an adapter cap that connects with the housing assembly at said housing assembly opening, said adapter cap having an adapter cap opening that is sized and shaped to enable passage of the hose through the adapter cap opening.

3. The oxygen hose reel mechanism of claim 2 wherein the coil spring attaches at a first spring end portion to a spring post on the base in between the periphery and the center of the rotation of the reel.

4. The oxygen hose reel mechanism of claim 2 further comprising multiple posts that connect the spring loaded disk to the lower flange of the hose reel.

5. The oxygen hose reel mechanism of claim 2 further comprising first and second pawl stop posts that limit movement of the pawl to the space between said pawl stop posts.

6. The oxygen hose reel mechanism of claim 5 wherein the pawl shifts alternatively away from and back toward each of the pawl stop posts as the spring loaded disk is rotated.

7. The oxygen hose reel mechanism of claim 2 wherein the pawl is pivotally attached to a pawl pivot post that extends between the base and the spring loaded disk.

8. The oxygen hose reel mechanism of claim 7 wherein the pawl post extends downwardly from the spring loaded disk.

9. The oxygen hose reel mechanism of claim 2 wherein one or more of said teeth on the base are engaged by the pawl.

10. The oxygen hose reel mechanism of claim 2 wherein the base peripheral portion has notches that are connectable to the pawl.

11. The oxygen hose reel mechanism of claim 2 wherein the coil spring attaches at a second spring end portion to a central portion of said spring loaded disk.

12. The oxygen hose reel mechanism of claim 2 wherein the base has a peripheral portion with an inner surface and notches on said inner surface.

13. The oxygen hose reel mechanism of claim 2 wherein the pawl has a tapered shape.

14. The oxygen hose reel mechanism of claim 2 wherein the passage is located on the hollow barrel of the reel near the upper surface of the reel lower flange.

15. The oxygen hose reel mechanism of claim 14 wherein the passage includes a ramp.

16. The oxygen hose reel mechanism of claim 2 wherein a peripheral portion of the base has a projecting portion that engages the pawl to lock the spring loaded disk when the spring loaded disk is rotated to a first position and a notch that enables the pawl to move to a position that enables the spring loaded disk to rotate during retrieval of the hose wound on the reel.

17. An oxygen mechanism for medical oxygen supply for treatment or therapy comprising:

a) a housing assembly that includes a hose reel having upper and lower flanges and a center of rotation;

b) a cover that fits over the hose reel;

c) a barrel having barrel wall with an outer surface, a control barrel passageway, said barrel wall joining the hose reel flanges together;

d) said housing assembly including a base having a base peripheral portion that connects with said cover;

e) a spring loaded disk rotatably connected to said base;

f) a coil spring connected to said base and said spring loaded disk;

g) a pawl secured to the base below the spring loaded disk and in between the coil spring and the base peripheral portion;

h) the coil spring enabling a user to pull out hose stored on the reel as the reel rotates relative to the base;

i) the barrel having a passage extending from the outside surface of the barrel to the barrel hollow bore;

j) wherein the base peripheral portion has circumferentially spaced apart teeth and notches;

k) wherein when the pawl engages a said tooth, the spring loaded disk locks to the base;

l) wherein when the pawl engages a notch, the spring loaded disk rotates; and m) an adapter cap that is removably connectable to said housing at a housing opening, said adapter cap having a hose opening that is sized and shaped to enable the hose to pass through the adapter cap at said hose opening.

18. The oxygen hose reel mechanism of claim 17 further comprising first and second pawl stop posts that limit movement of the pawl to the space between said pawl stop posts.

19. The oxygen mechanism of claim 17 wherein the pawl shifts alternatively away from and back toward each of the pawl stop posts as the spring loaded disk is rotated.

20. The oxygen mechanism of claim 17 wherein the pawl has a tapered shape.

* * * * *